US009246246B2

(12) United States Patent
Saje et al.

(10) Patent No.: US 9,246,246 B2
(45) Date of Patent: Jan. 26, 2016

(54) TUNABLE CAST GROUNDING BLOCK FOR DRY SECTIONS

(71) Applicant: GM Global Technology Operations LLC, Detroit, MI (US)

(72) Inventors: Robert N. Saje, Shelby Township, MI (US); Keith J. Saari, Macomb Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 223 days.

(21) Appl. No.: 13/930,957

(22) Filed: Jun. 28, 2013

(65) Prior Publication Data

US 2015/0004815 A1 Jan. 1, 2015

(51) Int. Cl.

| | |
|---|---|
| ***H01R 4/66*** | (2006.01) |
| ***H01R 11/12*** | (2006.01) |
| ***H01R 4/64*** | (2006.01) |

(52) U.S. Cl.

CPC . *H01R 11/12* (2013.01); *H01R 4/64* (2013.01)

(58) Field of Classification Search

CPC ..... H01R 4/64; H01R 4/66; H01R 4/185; H01R 13/65802; H01R 13/648

USPC ..... 439/9, 92, 97, 85, 83, 95, 883

IPC ..... H01R 4/64, 4/66, 4/34, 4/185, 13/65802, H01R 13/648, 23/6873

See application file for complete search history.

(56) References Cited

U.S. PATENT DOCUMENTS

| | | | | |
|---|---|---|---|---|
| 6,250,975 | B1 * | 6/2001 | LaPointe | 439/883 |
| 7,241,151 | B1 * | 7/2007 | Bradshaw | 439/95 |
| 7,713,071 | B2 * | 5/2010 | Pearce | 439/97 |
| 8,038,821 | B2 * | 10/2011 | Burns | 156/233 |
| 8,287,219 | B2 * | 10/2012 | Opper et al. | 411/431 |
| 8,647,159 | B2 * | 2/2014 | Steeves | 439/798 |
| 8,974,254 | B2 * | 3/2015 | Esmacher et al. | 439/779 |

* cited by examiner

*Primary Examiner* — Hien Vu

(74) *Attorney, Agent, or Firm* — BrooksGroup

(57) ABSTRACT

A number of variations may include a casting having a raised integrated cast grounding block with tunable surfaces for routing an electrical grounding wire/strap via an eyelet and an anti-rotational tab attachment.

12 Claims, 2 Drawing Sheets

TUNABLE CAST GROUNDING BLOCK FOR DRY SECTIONS

TECHNICAL FIELD

The field to which the disclosure generally relates to includes grounding block assemblies for vehicles.

BACKGROUND

Vehicles may be equipped with one or more grounding blocks.

SUMMARY OF ILLUSTRATIVE VARIATIONS

A number of variations may include a casting having a raised integrated cast grounding block with tunable surfaces for routing an electrical grounding wire/strap via an eyelet and an anti-rotational tab attachment.

Other illustrative variations within the scope of the invention will become apparent from the detailed description provided hereinafter. It should be understood that the detailed description and specific examples, while disclosing variations of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1:
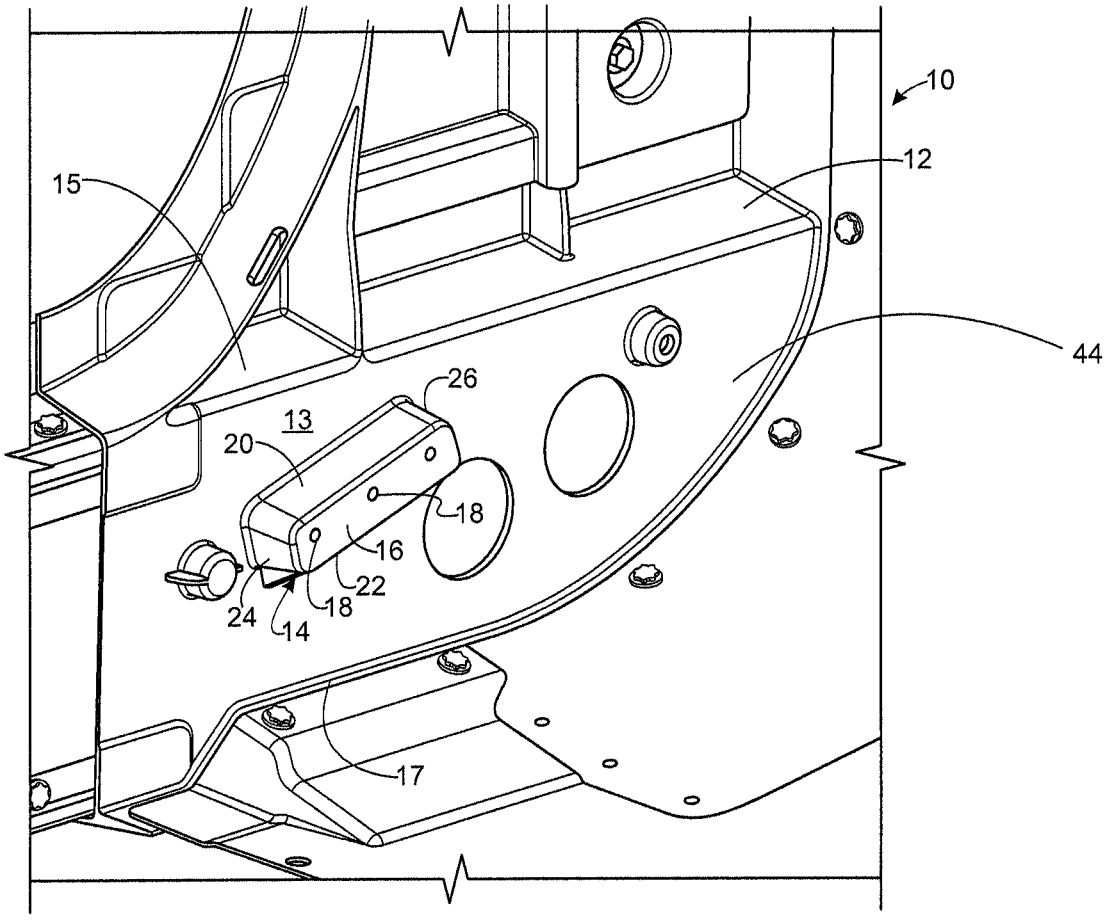
FIG. 1 is a partial, perspective view of a product including a casting including a raised integrated casting grounding block with tunable surfaces for routing an electrical grounding wire/strap via an eyelet and an anti-rotational tab attachment according to a number of variations.

Referring now to FIG. 1, a number of variations may include a product 10 which may include a structural component 12 for a vehicle. In a number of variations the structural component 12 may be made from a casted metal, such as but not limited to, a relatively light weight aluminum alloy. The structural panel 12 may include a first portion 13 which may be relatively flat from which may extend a raised grounding block 14. In a number of variations the raised grounding block 14 may be integrated in the casting of the structural component 12. The raised grounding block 14 may, in a number of variations, be an elongated structure and may be tuned in a vertical, horizontal or angled position with respect to at least one of a top edge 15 or a bottom edge 17 of the first portion 13 of the structural component 12. The raised grounding block 14 may include a top face 16 which may have a plurality of mounting holes 18 formed therein for mounting a grounding wire/strap attachment via a screw or other fastener. The raised grounding block 14 may include a first side face 20 and an opposite second side face 22, a third side face 24 and an opposite fourth side face 26 each extending upwardly from the first portion 13 to meet the top face 16. In a number of variations, the raised grounding block 14 may be formed in a cast front hinge pillar 44 for a vehicle.

Figure 2:
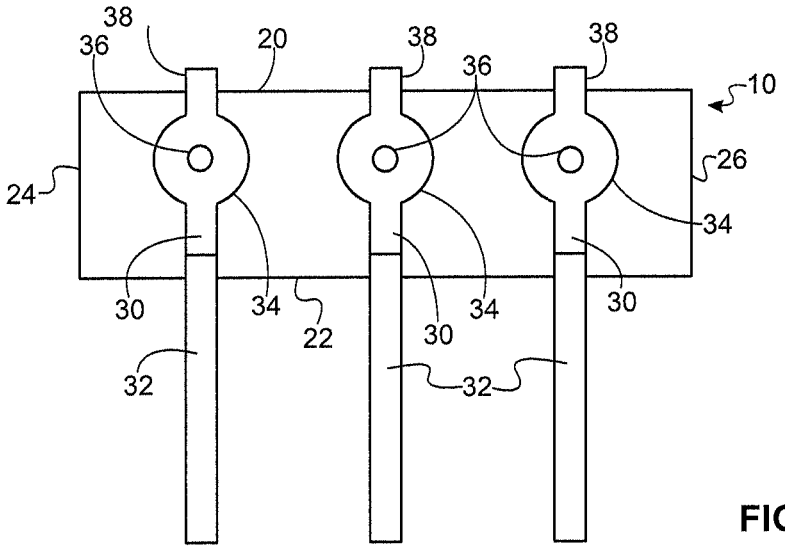
FIG. 2 is a schematic illustration of a product including a raised integrated cast grounding block having tunable surfaces and an electrical grounding wire/strap attached to the raised integrated cast grounding block via an eyelet and an anti-rotational tab attachment according to a number of variations of the invention.

FIG. 2 illustrates a product 10 which may include a raised grounding block 14 having a wire strap or at least a grounding wire 32 attached to an electrical connector 28 through a crimp portion 30, and an eyelet portion 34 having a through hole formed therein and a fastener such as a screw 36 extending through the through hole in the eyelet portion 34, and an anti-rotational tab 38 extending from the eyelet portion 34 constructed and arranged to prevent rotation of the connector 28 and to orient the strap or wire 28 along a prescribed approach. The design is particularly suitable for dry sections of the vehicle since no hole in the casting base plane is provided for anti-rotational tab. Other dry section approaches would require a block to be separately attached to keep the anti-rotational feature isolated from the casting base plane.

Figure 3:
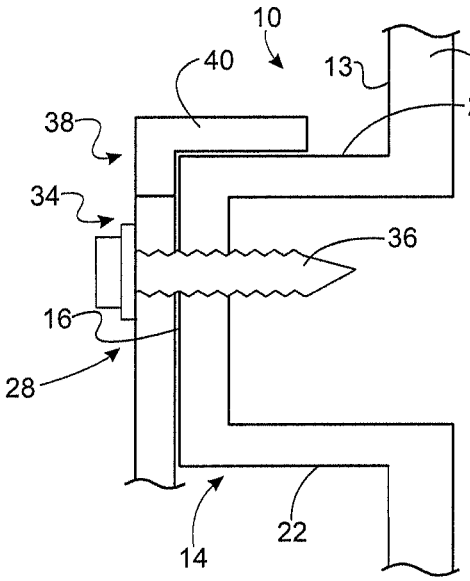
FIG. 3 is a sectional schematic illustration of a raised integrated cast grounding block and an electrical grounding wire/strap attachment eyelet having an anti-rotational tab with a bent leg according to a number of variations.

Referring now to FIG. 3, the electrical connector 28 includes a bent tab portion 38 extending from the eyelet portion 34. The bent tab portion 38 includes a downwardly or outboardly extending leg 40 constructed and arranged to engage the first side face 20 of the raised grounding block 14. The bent tab portion 38 prevents the electrical connector 28 from being rotated out of proper alignment with the raised grounding block 14.

Figure 4:
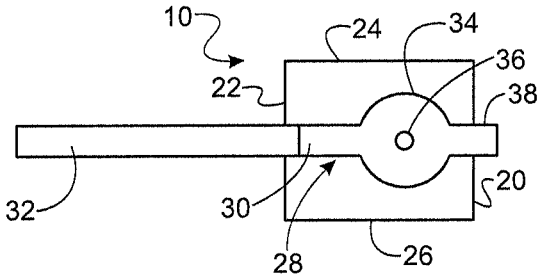
FIG. 4 is a schematic illustration of an alternative arrangement for a raised integrated cast grounding block having tunable surfaces which route an electrical grounding wire/strap via an eyelet and an anti-rotational tab attachment according to a number of variations.

FIG. 4 illustrates an alternative arrangement in which a single electrical connector 28 is attached to a raised grounding block 14.

Figure 5:
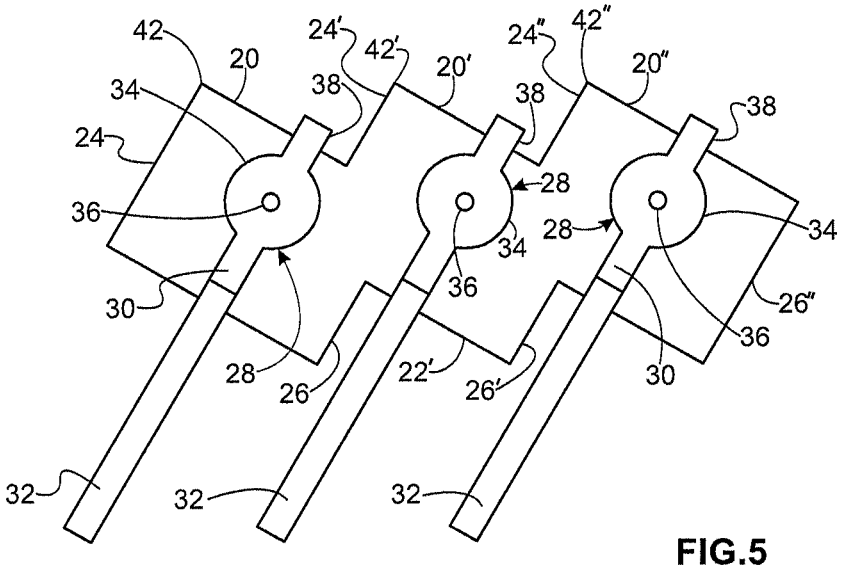
FIG. 5 illustrates yet another arrangement of a raised integrated cast grounding block having tunable surfaces which route an electrical grounding wire/strap via an eyelet and an anti-rotational tab attachment according to a number of variations.

Referring now to FIG. 5, and yet another arrangement, a plurality of angled connector block sections 8, 8', 8" may be joined together with an electrical connector 28 attached to each one of the raised grounding block sections 8, 8', 8". The a plurality of angled connector block sections 8, 8', 8" may form a zigzag edge. A first raised grounding block section 8 may include a first side face 20, opposite second side face 22, third side face 24 and opposite fourth side face 26. The first side face 20 and the third side face 24 may be connected together to form a corner 42. The second raised grounding block portion 8' may include a first side face 20' and opposite second side face 22', a third side face 24' and opposite fourth side face 26'. The first side face 20' and third side face 24' may be joined together to form a corner 42'. The third raised grounding block section 8" may include a first side face 20" and opposite second side face 22", a third side face 24" and opposite fourth side face 26". The first side face 20" may join the third side face 24" to form a corner 42". In a number of variations, the raised ground block sections 8, 8', 8" may be constructed and arranged so that at least one of: the corners 42, 42' and 42" are in a line; the first side faces 20, 20', and 20" are parallel; the second side faces 22, 22' and 22" are parallel;

the third side faces 24, 24' and 24" are parallel; or the fourth side faces 26, 26' and 26" are parallel.

The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may include a product comprising: a cast structural component for a vehicle including a first portion and a raised grounding block extending from the first portion, wherein the raised grounding block and the first portion are an integral, single piece casting, and wherein the raised grounding block has tunable surfaces constructed and arranged for routing an electrical grounding wire/strap attached to the raised grounding block via an electrical connector including an eyelet and an anti-rotational tab.

Variation 2 may include a product as set forth in Variation 1 wherein the cast structural component comprises a cast aluminum alloy.

Variation 3 may include a product as set forth in Variation 2 wherein the cast structure component is a front hinge pillar for a vehicle.

Variation 4 may include a product as set forth in any of Variations 1-3 wherein the raised grounding block include at least one mounting hole for attaching an electrical connector thereto.

Variation 5 may include a product as set forth in any of Variations 1-4 wherein the raised grounding block includes a first side face and opposite second side face, a third side face and opposite fourth side face each extend upward from the first portion and meeting a top face.

Variation 6 may include a product as set forth in Variation 5 wherein the first face is planar and wherein the first portion includes a top edge and an opposite bottom edge and wherein the first face is formed at an angle with respect to at least one of the top edge or bottom edge of the first portion.

Variation 7 may include a product as set forth in any of Variations 1-6 wherein the first portion includes a top edge and an opposite bottom edge and wherein the raised grounding block is an elongated structure is formed at an angle with respect to at least one of the top edge or bottom edge of the first portion.

Variation 8 may include a product as set forth in Variation 5 wherein the top face includes at least one mounting hole for attaching an electrical connector thereto.

Variation 9 may include a product as set forth in any of Variations 1-8 wherein the raised ground block includes a plurality of angled raised ground sections forming a zigzag edge.

Variation 10 may include a product as set forth in any of Variations 1-9 further comprising an electrical connector having a clamp portion, an eyelet portion having a through ole form therein, and a bend tab extending from the eyelet portion, the electrical connector being attached to the raised grounding block and at least one grounding wire being attached to the electrical connector by the crimp portion.

Variation 1 may include a product as set forth in any of Variations 110 wherein the raised grounding block includes a first face extending upward from the first portion and wherein the bend tab includes a downward extending large engaging the first face to prevent rotation of the electrical connector.

The above description of select variations within the scope of the invention is merely illustrative in nature and, thus, variations or variants thereof are not to be regarded as a departure from the spirit and scope of the invention.

What is claimed is:

1. A product comprising:

a cast structural component for a vehicle including a first portion and a raised grounding block extending from the first portion, wherein the raised grounding block and the first portion are an integral single piece casting, and wherein the raised grounding block has tunable positions on surfaces of the cast structural component that constructed and arranged for routing an electrical grounding wire attached to the raised grounding block via an electrical connector including an eyelet and an anti-rotational rob;

wherein the raised grounding block include at least one mounting hole for attaching the electrical connector thereto with a mechanical fastener.

2. A product as set forth in claim 1 wherein the cast structural component comprises a cast aluminum alloy.

3. A product as set forth in claim 1 wherein the cast structure component is a front hinge pillar for a vehicle.

4. A product as set forth in claim 1 wherein the raised grounding block includes a first side face and opposite second side face, a third side face and opposite fourth side face each extend upward from the first portion and meeting a top face.

5. A product as set forth in claim 4 wherein the top face includes at least one mounting hole for attaching an electrical connector thereto.

6. A product as set forth in claim 1 wherein the raised ground block includes a plurality of angled raised ground sections forming a zigzag edge.

7. A product as set forth in claim 1 wherein the electrical connector has a crimp portion, an eyelet portion having a through hole formed therein, and a bent tab extending from the eyelet potion, the electrical connector being attached to the raised grounding block and at least one grounding wire being attached to the electrical connector by the crimp portion.

8. A product as set forth in claim 7 wherein the raised grounding block includes a first face extending upward from the first portion and wherein the bent tab includes a downward extending large engaging the first face to prevent rotation of the electrical connector.

9. A product comprising;

a structural casting for a vehicle comprising a base panel and a raised ground block, wherein the raised ground block is constructed and arranged for attachment of a ground wire by an attachment screw so that an anti-rotation feature having an eyelet portion connecting to the ground wire does not penetrate into the base panel of the vehicle to maintain a dry section: and wherein the raised ground block has a height or thickness so that the fastener attachment screw having a shaft and end be able completely received in the raised ground block.

10. A product as set forth in claim 9 further comprising a ground wire or strap fastener attached to the raised ground block by a screw extending into but contained within the raised grounding block.

11. A product comprising: a cast structural component for a vehicle including a first portion and a raised grounding block extending from the first portion, wherein the raised grounding block and the first portion are an integral single piece casting, wherein the raised grounding block has tunable positions on surfaces of the cast structural component that constructed and arranged for routing an electrical grounding wire or strap attached to the raised grounding block via an electrical connector including an eyelet and an anti-rotational tab; wherein the raised grounding block includes a first side face and opposite second side face, a third side face and opposite fourth side face each extending upward from the first portion and meeting a top face; and wherein the first side face is planar and wherein the first portion includes a top edge and an opposite bottom edge and wherein the first face is formed at an angle with respect to at least one of the top edge or bottom edge of the first portion.

12. A product comprising: a cast structural component for a vehicle including a first portion and a raised grounding block extending from the first portion, wherein the raised grounding block and the first portion are an integral single piece casting, wherein the raised grounding block has positions on surfaces of the cast structural component that constructed and arranged for routing an electrical grounding wire or strap attached to the raised grounding block via an electrical connector including an eyelet and an anti-rotational tab; and wherein the first portion includes a top edge and an opposite bottom edge and wherein the raised grounding block is an elongated structure formed at an angle with respect to at least one of the top edge or bottom edge of the first portion.

* * * * *